US008684354B2

(12) United States Patent
Iino et al.

(10) Patent No.: US 8,684,354 B2
(45) Date of Patent: Apr. 1, 2014

(54) IMAGE FORMING DEVICE

(75) Inventors: Hikaru Iino, Nagoya (JP); Hiroshi Nobe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 158 days.

(21) Appl. No.: 13/247,378

(22) Filed: Sep. 28, 2011

(65) Prior Publication Data

US 2012/0104677 A1 May 3, 2012

(30) Foreign Application Priority Data

Oct. 29, 2010 (JP) ..... 2010-244130

(51) Int. Cl.
*B65H 9/16* (2006.01)

(52) U.S. Cl.
USPC ..... 271/251; 271/186; 271/301

(58) Field of Classification Search
USPC ..... 271/248, 251, 186, 301
See application file for complete search history.

(56) References Cited

U.S. PATENT DOCUMENTS

| | | | | |
|---|---|---|---|---|
| 5,494,277 | A | 2/1996 | Flores | |
| 6,145,828 | A * | 11/2000 | Arai | 271/3.03 |
| 6,340,157 | B1 * | 1/2002 | Watanabe et al. | 271/301 |
| 6,618,577 | B2 * | 9/2003 | Omura | 399/401 |
| 6,840,514 | B1 * | 1/2005 | Westhoff | 271/248 |
| 6,980,766 | B2 | 12/2005 | Ito | |
| 6,993,282 | B2 | 1/2006 | Kimizuka | |
| 7,168,701 | B2 * | 1/2007 | Isaka et al. | 271/273 |
| 7,490,829 | B2 * | 2/2009 | Heemskerk | 271/250 |
| 7,571,908 | B2 * | 8/2009 | Inui et al. | 271/251 |
| 7,905,483 | B2 | 3/2011 | Murakami et al. | |
| 2004/0051769 | A1 | 3/2004 | Tsusaka et al. | |
| 2004/0190963 | A1 | 9/2004 | Ito | |
| 2004/0212144 | A1 * | 10/2004 | Hozumi | 271/225 |

(Continued)

FOREIGN PATENT DOCUMENTS

| | | |
|---|---|---|
| JP | H05-241397 A | 9/1993 |
| JP | H06-166451 A | 6/1994 |

(Continued)

OTHER PUBLICATIONS

Japan Patent Office, Notice of Reasons for Rejection for Japanese Patent Application No. 2010-244130 (counterpart Japanese patent application), mailed Jan. 29, 2013.

(Continued)

*Primary Examiner* — Prasad Gokhale
(74) *Attorney, Agent, or Firm* — Baker Botts L.L.P.

(57) ABSTRACT

An image forming device includes a sheet conveyor, an image former that forms an image on a surface of a sheet conveyed by the sheet conveyor, and a re-conveyor that re-conveys the sheet to the image former which forms another image on an opposite surface of the sheet. The re-conveyor includes a guide member including upper and lower conveyance members, a regulation member that regulates a position of the sheet, a conveyer roller set that conveys the sheet therebetween, an urger that urges a pinch roller toward a driving roller, and a roller holder disposed above the upper conveyance member. The upper conveyance member has ends which are secured independently to the lower conveyance member. The roller holder secures the pinch roller overlaps the upper conveyance member in a vertical direction, and secures the pinch roller, such that the pinch roller contacts the sheet through the upper conveyance member.

17 Claims, 6 Drawing Sheets

(56) References Cited

U.S. PATENT DOCUMENTS

| | | | | |
|---|---|---|---|---|
| 2007/0273092 | A1* | 11/2007 | Inui | 271/251 |
| 2009/0160125 | A1* | 6/2009 | Fujita et al. | 271/227 |
| 2009/0189336 | A1* | 7/2009 | Otake | 271/147 |
| 2009/0295077 | A1 | 12/2009 | Murakami et al. | |
| 2010/0327520 | A1* | 12/2010 | Inui | 271/251 |
| 2012/0104678 | A1 | 5/2012 | Iino et al. | |

FOREIGN PATENT DOCUMENTS

| | | | |
|---|---|---|---|
| JP | H07-069494 | A | 3/1995 |
| JP | 2002-104694 | A | 4/2002 |
| JP | 2004-018217 | A | 1/2004 |
| JP | 2004-102165 | A | 4/2004 |
| JP | 2004-294988 | A | 10/2004 |
| JP | 2009-179411 | A | 8/2009 |
| JP | 2009-286587 | A | 12/2009 |

OTHER PUBLICATIONS

Japan Patent Office, Notice of Reasons for Rejection for Japanese Patent Application No. 2010-243880 (counterpart Japanese patent application), mailed Jan. 29, 2013.

State Intellectual Property Office of the People's Republic of China, Notification of the First Office Action for Chinese Patent Application No. 201110317380.8 (related to above-captioned patent application), mailed Jan. 2, 2014.

State Intellectual Property Office of the People's Republic of China, Notification of the First Office Action for Chinese Patent Application No. 201110317291.3 (related to above-captioned patent application), mailed Jan. 6, 2014.

* cited by examiner

IMAGE FORMING DEVICE

CROSS-REFERENCE TO RELATED APPLICATION

This application claims priority to Japanese Patent Application No. 2010-244130, filed on Oct. 29, 2010, which is incorporated herein by reference.

BACKGROUND OF THE INVENTION

1. Field of the Invention

The invention relates to an image forming device that performs single-sided and double-sided printing.

2. Description of the Related Art

A known image forming device includes a re-conveying unit for returning an inverted paper sheet with an image formed on a first surface thereof to an image forming unit. A known image forming device, e.g., the image forming device described in Japanese Unexamined Patent Application Publication No. 2002-104694, includes conveyor rollers for conveying the paper sheet obliquely toward a one-side regulation member provided at one width direction end of the paper sheet. In a known image forming device, conveyor rollers may have a rubber-made driving roller and a resin-made pinch roller which follows the driving roller. The pinch roller is disposed obliquely to the driving roller so as to obliquely convey the paper sheet. The pinch roller is disposed in contact with the first surface on which an image has been formed.

In a known image forming device, however, if a resin-made pinch roller is disposed in contact with the printing surface of the paper sheet as described above, the pinch roller slips against the printing surface and, as a result, the oblique feeding capability may decrease. This problem is more likely to occur when glossy paper is used or when color printing is performed in which multiple colors are superimposed on top of one another.

SUMMARY OF THE INVENTION

Therefore, a need has arisen for systems and methods for an image forming apparatus, and it is an object of the invention to overcome these and other deficiencies of the related art. Specifically, in an embodiment of the invention, the oblique feeding capability of conveyor rollers in a re-conveying unit may be increased and improved. In an embodiment of the invention, the second pinch roller may have a greater coefficient of friction, e.g., with respect to the recording sheet, than the first pinch roller. Thus, the recording sheet may be conveyed obliquely by the second pinch roller with a high coefficient of friction until the recording sheet comes into contact with the one-side regulation member even if the first pinch roller slips on a first surface on which an image has been formed. In an embodiment of the invention, the oblique feeding capability of the conveyor rollers of the re-conveying unit may be improved.

In an embodiment of the invention, an image forming device comprising: a sheet conveying unit configured to convey a plurality of sheets; an image forming unit configured to form an image on a first surface of a sheet that is conveyed from the plurality of sheets by the sheet conveying unit; and a re-conveying unit configured to re-convey the sheet along a re-conveying path to the image forming unit such that the image forming unit is configured to form another image on a second surface of the sheet opposite the first surface. The re-conveying unit comprises: a guide member; a single side regulation member extending in a particular direction and configured to contact a particular end of the sheet to regulate a position of the sheet; a conveyer roller set configured to convey the sheet therebetween; an urging member configured to urge the pinch roller toward the driving roller; and a roller holder disposed above the upper conveyance member. The guide member comprises: a lower conveyance member disposed below the re-conveying path; and an upper conveyance member secured to the lower conveyance member and disposed above the re-conveying path. The conveyor roller set comprises: a driving roller configured to receive a driving force; and a pinch roller configured to contact the first surface of the sheet. The upper conveyance member has a first end and a second end opposite to the first end in a direction perpendicular to the particular direction, and the first end and the second end of the upper conveyance member are independently secured to the lower conveyance member. The roller holder is configured to secure the pinch roller to the upper conveyance member, disposed to overlap the upper conveyance member in a vertical direction, and configured to secure the pinch roller such that the pinch roller is configured to contact the sheet through an opening formed in the upper conveyance member.

In another embodiment of the invention, an image forming device comprises: a sheet container unit configured to store a plurality of sheets therein and configured to slide in a particular direction; an image forming unit configured to form an image on a first surface of a sheet that is conveyed from the plurality of sheets in the sheet container unit; and a re-conveying unit configured to re-convey the sheet along a re-conveying path to the image forming unit such that the image forming unit is configured to form another image on a second surface of the sheet opposite the first surface. The re-conveying unit comprises: a guide member; a single side regulation member extending in a particular direction and configured to contact a particular end of the sheet to regulate a position of the sheet; a conveyer roller set configured to convey the sheet therebetween; an urging member configured to urge the pinch roller toward the driving roller; and a roller holder disposed to overlap the upper conveyance member in a vertical direction. The guide member comprises: a lower conveyance member disposed below the re-conveying path; and an upper conveyance member secured to the lower conveyance member and disposed above the re-conveying path. The conveyor roller set comprises: a driving roller configured to receive a driving force; and a pinch roller configured to contact the first surface of the sheet. The upper conveyance member has a first end and a second end opposite to the first end in a direction perpendicular to the particular direction, and the first end and the second end are independently secured to the lower conveyance member. The roller holder is configured to secure the pinch roller such that the pinch roller is configured to rotate in a hole formed in the upper conveyance member.

In yet another embodiment of the invention, an image forming device comprises: a sheet container unit configured to store a plurality of sheets therein and configured to slide in a particular direction; an image forming unit configured to form an image on a first surface of a sheet that is conveyed from the plurality of sheets in the sheet container unit; and a re-conveying unit configured to re-convey the sheet along a re-conveying path to the image forming unit such that the image forming unit is configured to form another image on a second surface of the sheet opposite the first surface. The re-conveying unit comprises: a guide member; a single side regulation member extending in a particular direction and configured to contact a particular end of the sheet to regulate a position of the sheet; a conveyer roller set configured to convey the sheet therebetween; an urging member configured to urge the pinch roller toward the driving roller; and a roller holder disposed above the upper conveyance member. The guide member comprises a lower conveyance member disposed below the re-conveying path; and an upper conveyance member secured to the lower conveyance member and disposed above the re-conveying path. The conveyor roller set comprises: a driving roller configured to receive a driving force; and a pinch roller configured to contact the first surface of the sheet. The upper conveyance member has a first end and a second end opposite to the first end in a direction perpendicular to the particular direction, and the first end and the second end are independently secured to the lower conveyance member. The roller holder is configured to secure the pinch roller such that a central axis of the pinch roller is not aligned with the upper conveyance member in the vertical direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-6, like numerals being used for like corresponding portions in the various drawings.

Figure 1:
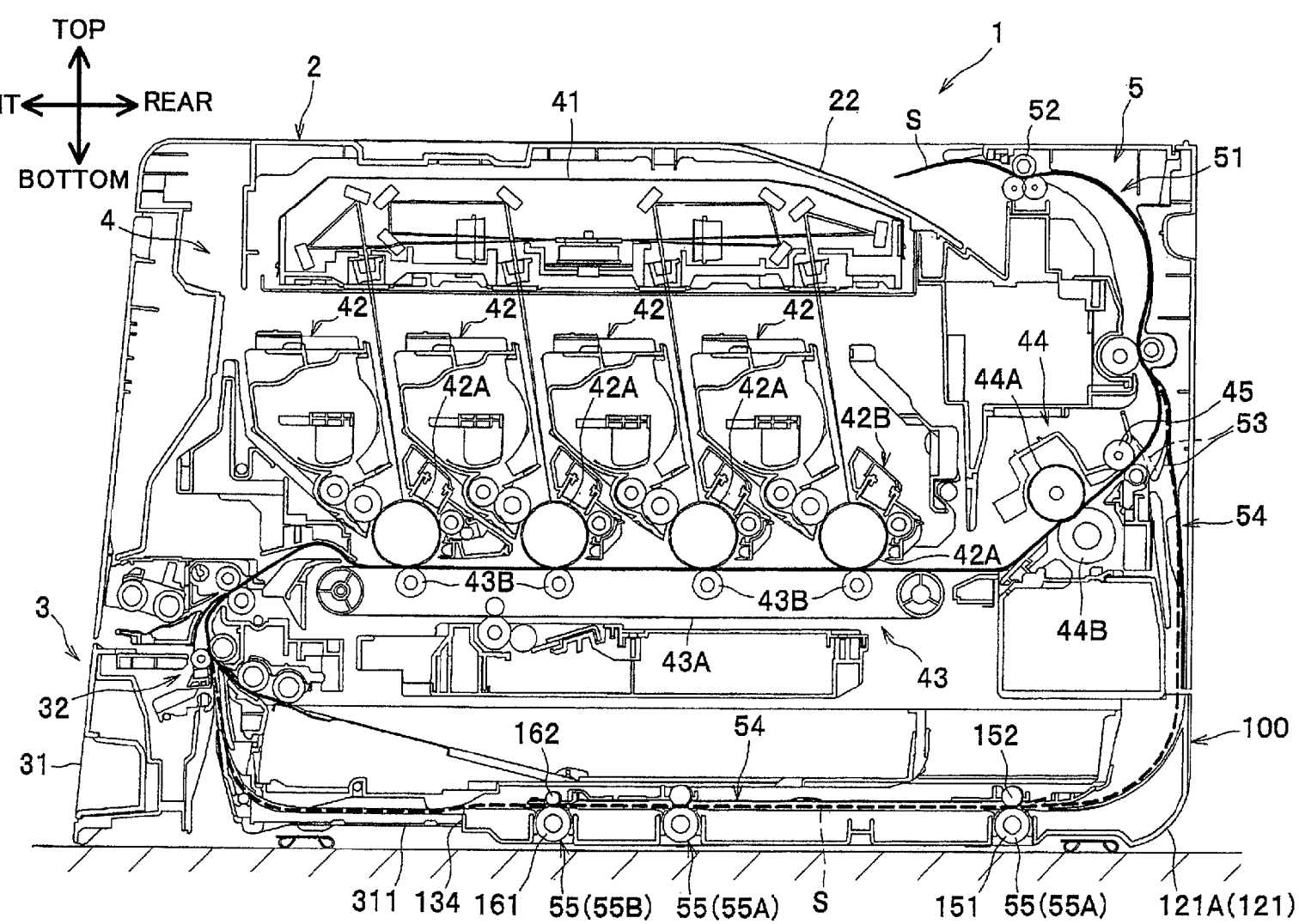
FIG. 1 depicts a side cut-away view of an image forming device, e.g., a color printer, according to an embodiment of the invention.

Hereinafter, an embodiment of the present invention is described in detail with reference to FIG. 1 which depicts a structure of an image forming device, e.g., color printer 1, according to an embodiment of the invention. Color printer 1 may comprise a re-conveying unit 100, which will be described in more detail herein with respect to FIGS. 2-4. In the following descriptions, directions may be defined with reference to a user who is using the color printer 1. Specifically, when oriented as depicted in FIG. 1, the left side of the page may be a "front side," hereinafter interchangeably referred to as a "near side," e.g., "nearer" to the user than the opposite side. The right side of the page may be a "rear side," hereinafter interchangeably referred to as a "back side." Similarly, the back side of the page, e.g., the unseen side, may be a "left side," and the near, visible side of the page may be a "right side," of the color printer 1. The vertical direction of the page of FIG. 1 may be referred to as a "vertical direction" with reference to the color printer 1.

As depicted in FIG. 1, the color printer 1 may be an apparatus that forms images on both surfaces of a recording sheet, e.g., a paper sheet S. The color printer 1 may comprise a paper feeding unit 3, an image forming unit 4, and a conveying unit 5, which may be disposed in an apparatus main body 2. The paper feeding unit 3, which may be disposed at a lower portion of the apparatus main body 2, may comprise a paper feed tray 31, e.g., a sheet container unit configured to accommodate, e.g., to store, a plurality of sheets, including a paper sheet S, and a paper feeding mechanism 32. The paper feeding mechanism 32 may feed the paper sheet S from the paper feed tray 31 to the image forming unit 4. The paper feed tray 31 may be removed from the apparatus main body 2 by exerting a force pulling the paper feed tray 31 away from the apparatus main body 2, and the paper feed tray 31 may be replaced into the apparatus main body by exerting a force pushing the paper feed tray 31 into the apparatus main body 31.

The image forming unit 4 for forming an image on the paper sheet S conveyed from the plurality of sheets in the paper feeding unit 3 may comprise an exposure unit 41, four process units 42, a transfer unit 43 and a fixing unit 44. The exposure unit 41 may be disposed at an upper portion of the apparatus main body 2. The exposure unit 41 may comprise a laser light source (not depicted), a polygon mirror, a plurality of lenses and a plurality of reflectors. With reference to FIG. 1, the polygon mirror, plurality of lenses, and plurality of reflectors are not assigned reference numerals. The laser light source may emit laser light that corresponds to image data. The emitted laser light may be reflected by the polygon mirrors and the reflectors, such that the laser light may pass through the lenses and then rapidly scan a surface of each of photosensitive drums 42A.

The process units 42 may be disposed serially in a direction from the front side of the color printer 1 to the rear side of the color printer 1, hereinafter interchangeably referred to as a front-to-rear direction, and disposed between the paper feed tray 31 and the exposure unit 41. Each process unit 42 may comprise a photosensitive drum 42A, a charging unit 42B, a developing roller, a supply roller, a layer-thickness regulating blade and a toner container unit which accommodates toner, e.g., a developing agent. With reference to FIG. 1, the developing roller, supply roller, layer-thickness regulating blade, and toner container unit are not assigned reference numerals. Each process unit 42 may be substantially the same in structure, except that, in an embodiment of the invention, each process unit 42 may accommodate a different color of toner in the toner container unit.

The transfer unit 43 may be disposed between the paper feed tray 31 and the process units 42. The transfer unit 43 may comprise an endless conveyor belt 43A stretched between a driving roller and a driven roller, which are not assigned reference numerals in FIG. 1, and four transfer rollers 43B. An outer surface of the conveyor belt 43A may be in contact with the photosensitive drums 42A. The conveyor belt 43A may be held between each of the transfer rollers 43B, which may be disposed inside the conveyor belt 43A, and each of the photosensitive drums 42A.

The fixing unit 44 may be disposed behind the process units 42. The fixing unit 44 may comprise a heat roller 44A and a pressure roller 44B disposed opposite to the heat roller 44A to press the heat roller 44A. In the image forming unit 4, the charging unit 42B may uniformly charge the surface of each of the photosensitive drums 42A. Then, the exposure unit 41 may emit laser light that exposes each of the photosensitive drums 42A to the emitted laser light. As a result, an electrostatic latent image corresponding to the image data may be formed on each of the photosensitive drums 42A. A supply roller may supply the toner in the toner container unit to the developing roller. The supplied toner in the developing roller may enter between the developing roller and the layer-thickness regulating blade, and may form a thin toner layer of fixed thickness that is supported on the developing roller.

The toner supported on the developing roller then may be supplied to each of the photosensitive drums 42A on which the electrostatic latent image is formed. Then, the electrostatic latent image may be visualized and a toner image may be formed on each of the photosensitive drums 42A. Then, the paper sheet S may be fed from the paper feeding unit 3 and may be conveyed between the photosensitive drums 42A and the conveyor belt 43A. After that, the toner images formed on the photosensitive drums 42A may be sequentially transferred to the paper sheet S to be superimposed on top of one another.

The paper sheet S on which the toner images have been transferred then may be conveyed between the heat roller 44A and the pressure roller 44B for the heat-fusing of the toner images. In this manner, an image may be formed on a first surface, e.g., a first side, of the paper sheet S. The paper sheet S on which the image has been formed may be output to a conveying path 51 from the fixing unit 44 by an output roller 45.

The conveying unit 5 may function as an output mechanism for outputting the paper sheet S from the image forming unit 4 to the outside of the apparatus main body 2 and, at the same time, may function as a re-conveying unit for re-conveying, to the image forming unit 4, the inverted paper sheet S with the image formed on the first surface thereof by the image forming unit 4. Specifically, the conveying unit 5 may comprise a conveying path 51, an output roller 52, a flapper 53 which may swing in the front-to-rear direction, a re-conveying path 54 and a plurality of conveyor rollers 55 that may convey the paper sheet S in the re-conveying path 54.

The conveying path 51 may be at the rear portion of the apparatus main body 2. The conveying path 51 may extend upward from a portion near the front side of a backwardly swung flapper 53, e.g., as depicted by the solid line in FIG. 1, and then may extend and curve to the front.

The output roller 52 may selectively rotate in both a forward and a reverse direction. When the output roller 52 is rotating in a forward direction, the paper sheet S may be outputted from the image forming unit 4 to the outside of the apparatus main body 2. When the output roller 52 is rotated in the reverse direction, the paper sheet S may be conveyed into the apparatus main body 2.

The re-conveying path 54 may extend from the rear portion of the apparatus main body 2 to the lower portion of the apparatus main body 2, as depicted in FIG. 1. The re-conveying path 54 may extend downward from a portion near the rear side of the forwardly swung flapper 53, e.g. as depicted by the dashed line in FIG. 1, and then may extend to the front below the paper feed tray 31 to curve to the front. The re-conveying path 54 then may extend to curve upward toward the paper feeding mechanism 32. Re-conveying unit 100, which will be described in more detail herein, may form at least a portion of the re-conveying path 54.

Upon completion of the image formation, the paper sheet S outputted from the image forming unit 4 may be conveyed along the conveying path 51. Then, the paper sheet S may be outputted to the outside of the apparatus main body 2 by the forwardly rotating output roller 52, and may be placed on the output tray 22. If an image is to be formed on a second surface of the paper sheet S opposite to the first surface on which an image already has been formed, then the paper sheet may be is drawn into the apparatus main body 2, conveyed along the conveying path 51, and then conveyed along the re-conveying path 54. The previous conveying may be performed by the output roller 52, which may rotate in the reverse direction before the entire paper sheet S is completely outputted from the apparatus main body 2. Then, the paper sheet S, as depicted by the dashed line in FIG. 1, may be conveyed on the re-conveying path 54 by the conveyor rollers 55, and then again may be conveyed to the image forming unit 4 by the paper feeding mechanism 32. After an image has been formed on the second surface of paper sheet S by the image forming unit 4, paper sheet S may be outputted from the image forming unit 4 and conveyed along the conveying path 51. Then, the paper sheet S may be outputted from the apparatus main body 2 by the forwardly rotating output roller 52. Paper sheet S then may be placed on the output tray 22.

Figure 2:
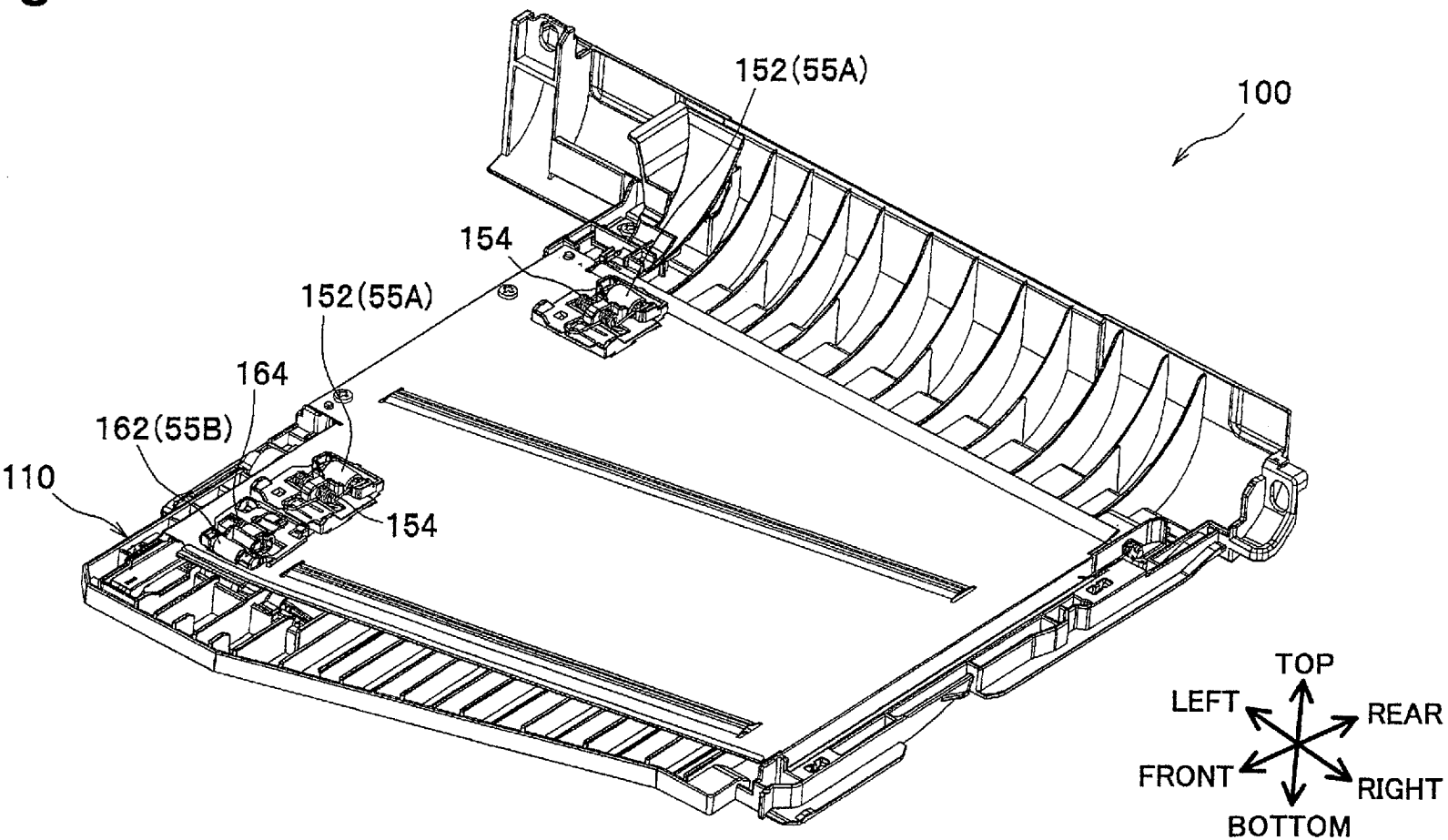
FIG. 2 is a perspective view of a re-conveying unit, according to an embodiment of the invention.
Figure 3:
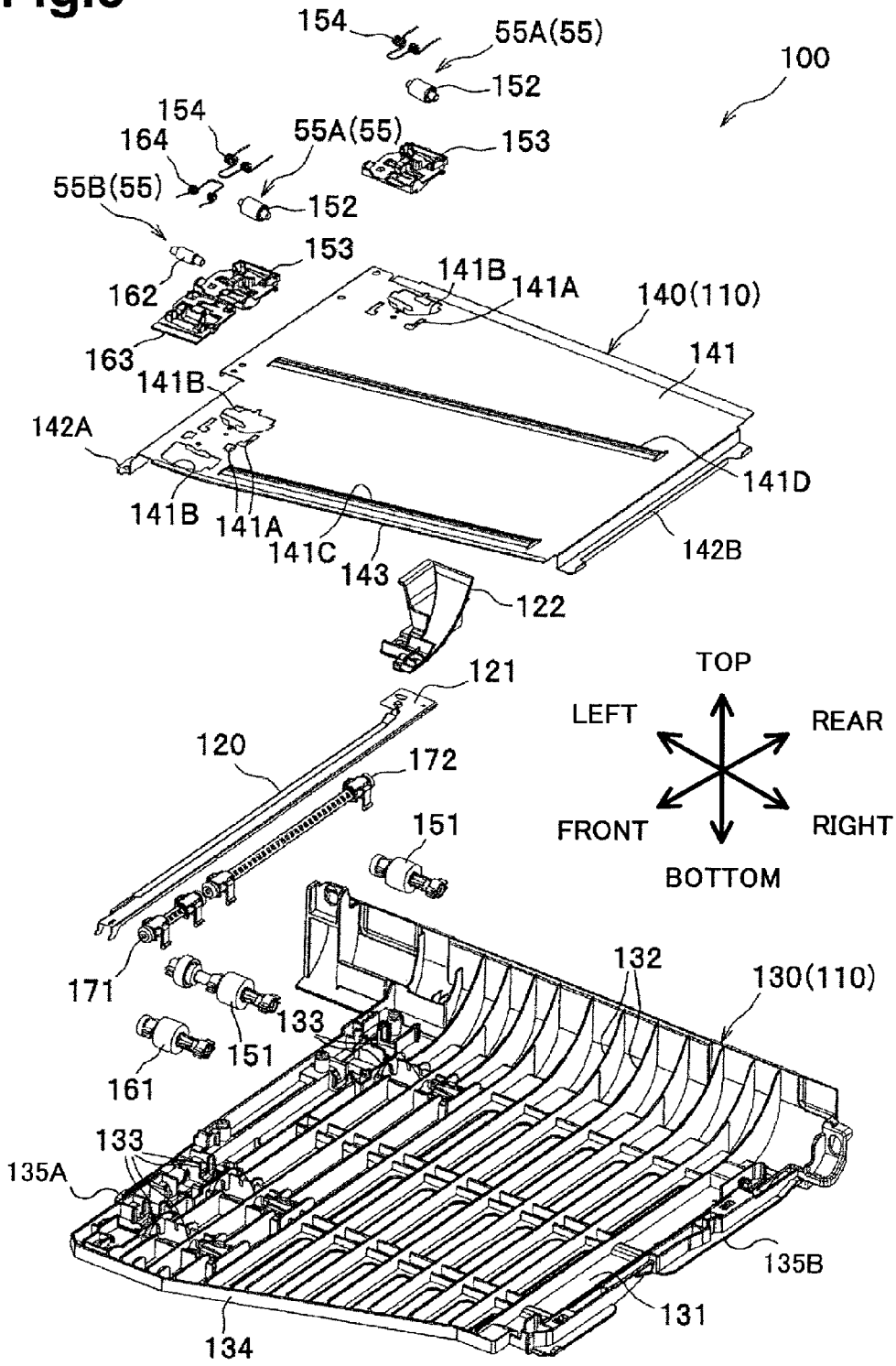
FIG. 3 is an exploded, perspective view of a re-conveying unit, according to an embodiment of the invention.

FIG. 2 depicts a re-conveying unit 100 according to an embodiment of the invention. Re-conveying unit 100 may be disposed below the paper feed tray 31. Re-conveying unit 100 may form a portion extending in the front-to-rear direction, e.g., a rear portion, of the re-conveying path 54. The re-conveying unit 100 may have a substantially flat plate shape, as depicted in FIG. 2. The re-conveying unit 100 may be fixed to the apparatus main body 2, and the paper feed tray 31 may be removably mounted to the re-conveying unit 100. The re-conveying unit 100 may comprise a guide member 110, a single-side regulation member 120, and two or more sets of conveyor rollers 55, e.g., two or more pairs of conveyor rollers 55, as illustrated in FIG. 3. The re-conveying unit 100 may re-convey the paper sheet S along the re-conveying path 54, such that paper sheet S may again pass through the image forming unit 4. The image forming unit 4 then may form another image on a second surface, e.g., a second side, of the paper sheet S. The second surface may be opposite to the first surface.

The guide member 110 may comprise a lower conveyance member 130 and an upper conveyance member 140. The lower conveyance member 130 may be disposed below the paper sheet S and the upper conveyance member 140 may be disposed above the paper sheet S, which may pass along the re-conveying path 54. The lower conveyance member 130 may have a width greater than the width of the paper sheet S, e.g., the length of the paper sheet S in the left-to-right direction. The lower conveyance member 130 may comprise a bottom wall portion 131, guide ribs 132, pivotal support portions 133 and a downstream end portion 134.

The bottom wall portion 131 may be substantially plate-shaped in its entirety, and a rear end portion thereof may be formed in an arc shape when viewed in a sectional view. The guide ribs 132 may project inwardly from the bottom wall portion 131 and may extend along the conveying direction of the paper sheet S. Each of the guide ribs 132 may be spaced from each other along the width direction of the paper sheet S. The pivotal support portions 133 may rotatably support driving rollers 151 and 161, which will be described later, and may be formed at the left portion of the bottom wall portion 131.

The downstream end portion 134 may have a shape of a rib projecting upward from the bottom wall portion 131, and may be formed to incline toward the rear side, e.g., the upstream side of the conveying direction of the paper sheet S from the left side to the right side. Thus, the entire leading end of the paper sheet S may be prevented from being caught in a joint of the lower conveyance member 130 and a downstream path forming portion 311, which will be described in more detail herein, with reference to FIG. 5.

The upper conveyance member 140, which may be formed from a metal sheet, may comprise an upper wall portion 141, a first end 142A and a second end 142B opposite to the first end 142A. The upper wall portion 141 may have a size that is greater than the width of the paper sheet S. Each of first end 142A and second end 142B may be bent downward at respective left-to-right direction ends of the upper wall portion 141. Each of first end 142A and second end 142B may be secured to, e.g., fixed to, or supported by the lower conveyance member 130. Thus, because the upper conveyance member 140 may be independently secured or supported by the lower conveyance member 130 at both first end 142A and second end 142B, deformation of the upper conveyance member 140 may be reduced or prevented, even if an urging force is applied to the upper conveyance member 140. In an embodiment of the invention, first end 142A may be secured to the lower conveyance member 130, e.g., by using fasteners, e.g., screws, and second end 142B may be supported by the lower conveyance member 130, e.g., by fitting into one or more recesses of lower conveyance member 130.

Mounting holes 141A and escape holes 141B may be formed at a left side of upper wall portion 141 therein. Mounting holes 141A may be configured to mount the roller holders 153 and 163, which will be described later. Similarly, escape holes 141B may be configured to let pinch rollers 152 and 162, which will be described later, to contact with the driving rollers 151 and 161. A downstream end portion 143 of the upper wall portion 141 may incline toward the rear side, e.g., the upstream side of the conveying direction of the paper sheet S, from the left side to the right side.

With this configuration, in the event of a paper jam in second conveyance rollers 55B, which may be disposed on the left side of the downstream end portion 143, a right corner of the paper sheet S may project further forward than the downstream end portion 143 does because the right side may be opened by the inclination of the downstream end portion 143. Thus, when the paper feed tray 31 is removed to expose the front end of the re-conveying unit 100, the right corner of the paper sheet S projecting from the downstream end portion 143 may be located easily, and the paper sheet S may be easily drawn out by the right corner.

Two reinforcing ribs 141C and 141D may be disposed in the upper wall portion 141 to extend from one end to the other end in the left-to-right direction, which may further reduce or prevent deformation of the upper conveyance member 140. Specifically, the reinforcing rib 141C may project upward at a position near the downstream end portion 143 of the upper wall portion 141. The reinforcing rib 141C may extend from a position slightly spaced to the right, apart from the escape holes 141B at the left end of upper wall portion 141, to a position near a right end of the upper wall portion 141. The reinforcing rib 141D may project upward at a substantially center position of the upper wall portion 141 in the front-to-rear direction. Reinforcing rib 141D may extend from a position near the right end of the upper wall portion 141 to a position over the escape holes 141B in the left-to-right direction. Thus, deformation of the upper conveyance member 140 may be further reduced or prevented by the reinforcing rib 141D, which may be longer than the reinforcing rib 141C.

The reinforcing ribs 141C and 141D may incline toward the rear side, e.g. the reinforcing ribs 141C and 141D may extend at an angle relative to the left-to-right direction, e.g., the direction perpendicular to the particular direction. Thus, the entire leading end of the paper sheet S may be prevented from being caught by the reinforcing ribs 141C and 141D. Additionally, if the leading end of the paper sheet S comes into contact with each of the reinforcing ribs 141C and 141D formed in an inclined manner, the paper sheet S may be obliquely fed along the reinforcing ribs 141C and 141D.

The single-side regulation member 120 may contact with the left end of the paper sheet S, and may regulate the width direction position of the paper sheet S. The single-side regulation member 120 may be formed in an elongated shape extending in the front-to-rear direction, e.g., a particular direction, and may be disposed on the left side of the lower conveyance member 130. A guide 122 may be disposed at a rear end portion 121 of the single-side regulation member 120. The guide 122 may guide a left end of the paper sheet S toward the right side surface, e.g., a guide surface of the single-side regulation member 120 when the paper sheet S is conveyed with the left end thereof protruding to the left across the right side surface of the single-side regulation member 120.

The conveyor rollers 55 may convey the paper sheet S obliquely in the conveying direction, such that the left end of the paper sheet S may be in contact with the single-side regulation member 120. The conveyor rollers 55 may be disposed at positions closer to the single-side regulation member 120 in the left-to-right direction, that is, the conveyor rollers 55 may be disposed at positions closer to the first end 142A of the upper conveyance member 140 than the second end 142B of the upper conveyance member 140. In particular, the conveyor rollers 55 may comprise two pairs of first conveyance rollers 55A and one pair of second conveyance rollers 55B disposed further downstream in the conveying direction than the first conveyance rollers 55A.

One of the two pairs of the first conveyance rollers 55A may be disposed at the rear end portion of the upper conveyance member 140 and the other may be disposed at a position adjacent to the second conveyance rollers 55B, spaced apart from the one of the two pairs of the first conveyance rollers 55A in the front direction. Each of the first conveyance rollers 55A may comprise a first driving roller 151 and a first pinch roller 152. The first driving roller 151 may receive a driving force transmitted from a driving source (not depicted). The first pinch roller 152 may be rotated following the first driving roller 151. The first pinch roller 152 may contact the first surface of the paper sheet S when the paper sheet S is conveyed by first conveyance rollers 55A. The first driving roller 151 may comprise a rubber conveyance surface and may be rotatably supported by the pivotal support portions 133 of the lower conveyance member 130.

The first pinch roller 152 may comprise a plastic conveyance surface, e.g. a surface that is harder and has less adhesive properties than, e.g., rubber. The conveyance surface of the first driving roller 151 may have a greater coefficient of friction than the plastic conveyance surface of the first pinch roller 152. The "coefficient of friction" referred to in this application may be understood as the coefficient of friction of the surface relative to the paper sheet S.

The first pinch roller 152 may be supported by the upper conveyance member 140 and may be located above the first driving roller 151. Specifically, as depicted in FIG. 1, the first pinch roller 152 may be in contact with the first surface of paper sheet S, e.g., the surface on which an image has already been formed. The first pinch roller 152 may be supported by a roller holder 153, such that the first pinch roller 152 may be rotatable and slidable in the vertical direction. Roller holder 153 may comprise a resin. First pinch roller 152 may be urged downward by a torsion spring 154, e.g., an urging member. Torsion spring 154 may be fixed to or supported by the roller holder 153. Thus, with this configuration, the first pinch roller 152 may be urged toward the first driving roller 151 by the torsion spring 154, such that the first pinch roller 152 may be in contact with the first driving roller 151 when the re-conveying unit 100 is in an assembled state as depicted in FIG. 2.

Figure 4:
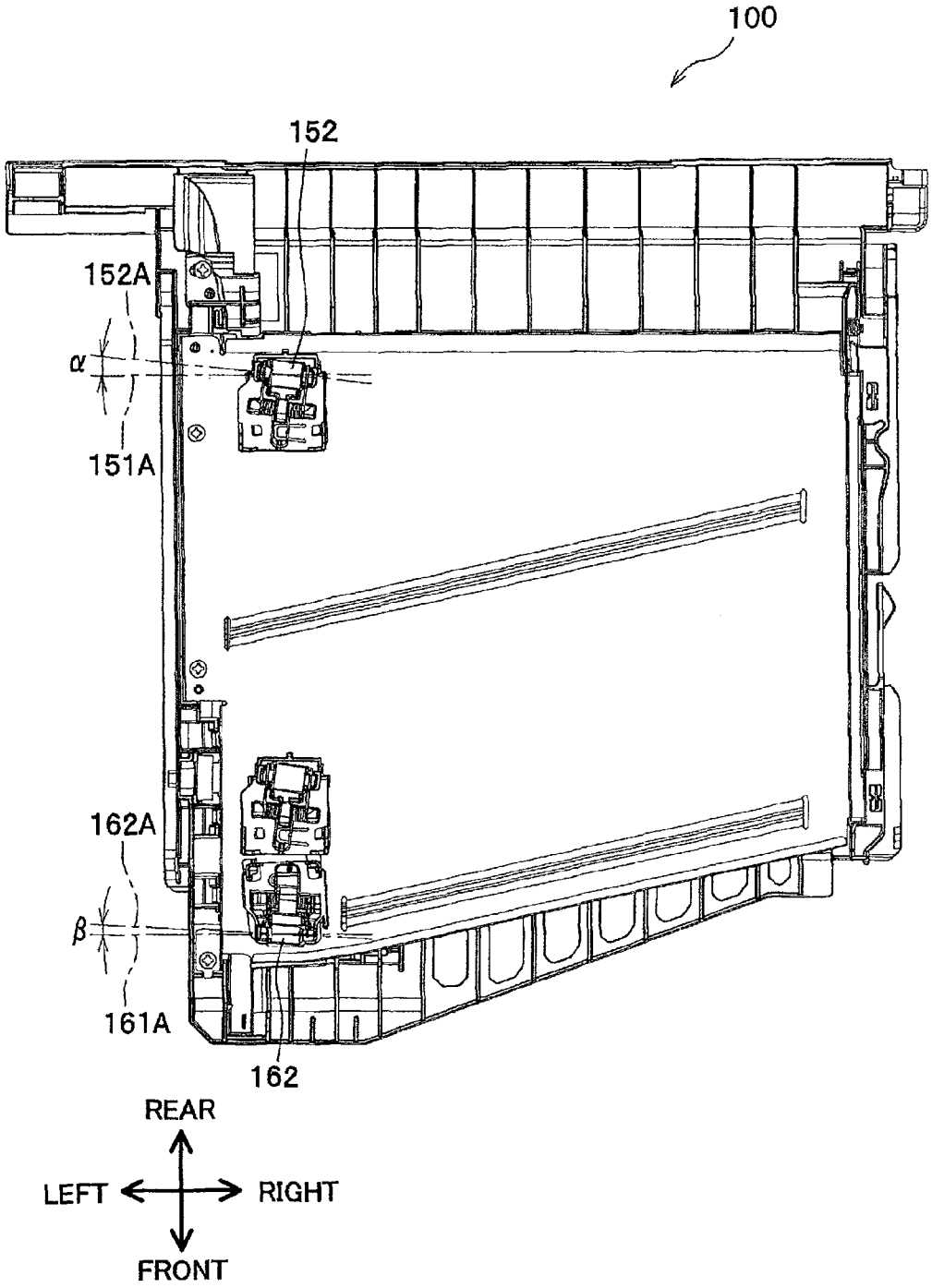
FIG. 4 is a top view of the re-conveying unit, according to an embodiment of the invention.

The first pinch roller 152 may incline with respect to the first driving roller 151 in the assembled state of the re-conveying unit 100. Specifically, as depicted in FIG. 4, a central axis 152A of the first pinch roller 152 may be inclined at a predetermined angle α. Specifically, the pinch roller 152 may be disposed at an angle, e.g., a first angle, relative to the first driving roller in the left-to-right direction, e.g., a direction perpendicular to the particular direction. Thus, the predetermined angle α may be an acute angle with respect to a central axis 151A of the first driving roller 151 in the left-to-right direction. In an embodiment of the invention, the predetermined angle α may be 6 degrees, for example, but in other embodiments, the predetermined angle α may have other values.

As depicted in FIG. 3, the second conveyance rollers 55B may be disposed at the downstream end portion 143 of the upper conveyance member 140. A distance between first conveyance rollers 55A and second conveyance rollers 55B may be greater than one half of a width of re-conveying unit 100 in the left-to-right direction, e.g., the direction perpendicular to the particular direction. The second conveyance rollers 55B may comprise a second driving roller 161 and a second pinch roller 162. The second driving roller 161 may receive a driving force transmitted from a driving source, e.g., a motor (not depicted). The second pinch roller 162 may rotate following the second driving roller 161. The second pinch roller 162 may contact the first surface of the paper sheet S when the paper sheet S is conveyed by second conveyance rollers 55B. The second driving roller 161 may comprise a rubber conveyance surface and may be rotatably supported by the pivotal support portions 133 of the lower conveyance member 130. As depicted in FIG. 3, upper conveyance member 140 may have escape holes 141B. Each of first pinch roller 152 and second pinch roller 162 may contact the sheet through one of escape holes 141B. Each of first pinch roller 152 and pinch roller 162 may rotate in one of escape holes 141B. As depicted in FIG. 4, the second pinch roller 162 may be disposed closer to the single side regulation member 120 than the first pinch roller 152.

The second driving roller 161 and the two first driving rollers 151 may be arranged in the front-to-rear direction, and may be connected by two driving force transmission members 171 and 172. Each of transmission members 171 and 172 may comprise a shaft and a gear. A driving source of the apparatus main body 2 may be connected to the driving roller 151 of the middle position via a plurality of gears, or any other suitable connecting mechanism. After the driving force from the driving source of the apparatus main body 2 is transmitted to the driving roller 151 in the middle, the driving force may be transmitted to the front and rear driving rollers 161 and 151 via each of the driving force transmission members 171 and 172.

Similarly to the first pinch roller 152, the second pinch roller 162, which may be supported by the upper conveyance member 140, also may be disposed in contact with the first surface of the paper sheet S. Also, similarly to the first pinch roller 152, the second pinch roller 162 may be supported by the roller holder 163 to be rotatable and slidable in the vertical direction. Second pinch roller 162 may be urged downward by the torsion spring 164, which may be fixed to the roller holder 163. With this configuration, the second pinch roller 162 may be urged toward the second driving roller 161 by the torsion spring 164 to be in contact with the second driving roller 161 when the re-conveying unit 100 is in an assembled state as depicted in FIG. 2. As depicted in FIGS. 2 and 4, roller holder 163 may be disposed above the upper conveyance member 140, and upper conveyance member 140 may secure or support roller holder 163. Roller holder 163 may be disposed to overlap upper conveyance member 140 in the vertical direction. As set forth above, roller holder 163 may support second pinch roller 162 to be rotatable and slidable in the vertical direction. Roller holder 163 also may secure second pinch roller 162 such that second pinch roller 162 may contact the sheet through one of the plurality of holes 141B in the upper conveyance member 140. Roller holder 163 may secure second pinch roller 162 such that the central axis of the second pinch roller 162 is not aligned with the upper conveyance member 140 in the vertical direction.

The second pinch roller 162 may comprise a rubber conveyance surface, which may have a greater coefficient of friction than the first pinch roller 152. Thus, even if the first pinch roller 152 slides on the printing surface of the paper sheet S, sliding of the paper sheet S on the printing surface may be reduced, and paper sheet S may be reliably obliquely conveyed by the second pinch roller 162, because the coefficient of friction of second pinch roller 162 may be greater than that of the first pinch roller 152.

The second driving roller 161 may have a greater coefficient of friction than the second pinch roller 162. That is, the rubber which forms the conveyance surface of the second driving roller 161 may have a greater coefficient of friction than the rubber that forms the conveyance surface of the second pinch roller 162. Thus, second pinch roller 162 may allow sliding on the printing surface and may feed the paper sheet S in a straight line in the conveying direction only by the second driving roller 161 after the paper sheet S comes into contact with the single-side regulation member 120. Thus, folding of the end of the paper sheet S, which may be caused by conveying the paper sheet S too close to the single-side regulation member 120, may be reduced or prevented.

In the assembled state of the re-conveying unit 100, the second pinch roller 162 may be inclined against the second driving roller 161 at an inclination angle β. Specifically, the pinch roller 162 may be disposed at an angle, e.g., a second angle, relative to the second driving roller in the left-to-right direction, e.g., the direction perpendicular to the particular direction. In an embodiment of the invention, inclination angle β may be, for example, 3 degrees, although in other embodiments of the invention, inclination angle β may have different values. In an embodiment of the invention, inclination angle β may be smaller than the inclination angle α of the first pinch roller 152 in the left-to-right direction, as illustrated in FIG. 4. That is, a central axis 162A of the second pinch roller 162 may be inclined at an angle β, which may be less than the angle α, with respect to the central axis 161A of the second driving roller 161 in the left-to-right direction.

Thus, with the strong conveying force of the rubber conveying surface of second pinch roller 162, folding of the end of the paper sheet S may be further reduced or prevented. Specifically, because a component of force applied to the paper sheet S in the direction perpendicular to the conveying direction by the first pinch roller 152 may be smaller than a component of force applied to the paper sheet S in the direction perpendicular to the conveying direction by the second pinch roller 162, folding of the end of the paper sheet S may be reduced or prevented.

The second conveyance rollers 55B, which may be disposed the furthest downstream in the conveying direction, may be positioned within the inclination of the downstream end portion 143 of the upper conveyance member 140 described above, e.g., the position which overlaps the inclination of the downstream end portion 143 in the width direction. Thus, the paper sheet S may be easily drawn from the right side of the inclined portion even if, for example, a paper jam occurs in a state in which the paper sheet S is caught in the second conveyance rollers 55B. The second conveyance rollers 55B also may be positioned closer to the first end 142A of the upper conveyance member 140 than the second end 142B of the upper conveyance member 140.

The downstream end portion 143 of the upper conveyance member 140 may be shorter than the downstream end portion 134 of the lower conveyance member 130 in the sheet conveying direction. Thus, the downstream end portion 143 of the upper conveyance member 140 may be disposed further upstream than the downstream end portion 134 of the lower conveyance member 130 in the sheet conveying direction. The downstream end portion 143 may extend from the first end 142A to the second end 142B of the upper conveyance member 140 at an angle relative to the left-to-right direction, e.g., the direction perpendicular to the particular direction. An angle formed by the first end 142A and the downstream end portion 143 may be less than 90 degrees.

First end 142A of upper conveyance member 140 may extend further than the second end 142B of upper conveyance member 140 in the front-to-back direction, e.g., the particular direction. Because first end 142A may extend further than second end 142B in the particular direction, first end 142A may be disposed closer to the image recording unit 4 in the conveyance direction than second end 142B.

Lower conveyance member 130 also may comprise a first end 135A and a second end 135B opposite to the first end 135A in the left-to-right direction, wherein the first end 135A of the lower conveyance member may be a left end, and the second end 135B of the lower conveyance member may be a right end, when the re-conveying unit 100 is positioned as depicted in FIG. 3. Downstream end portion 134 of the lower conveyance member 130 may extend from the first end 135A of lower conveyance member 130 to the second end 135B of lower conveyance member 130 at an angle relative to the left-to-right direction, e.g., the direction perpendicular to the particular direction. An angle formed by the first end 135A and the downstream end portion 134 may be less than 90 degrees.

The first end 135A of lower conveyance member 130 may extend further than the second end 135B of lower conveyance member 140 in the front-to-back direction, e.g., the particular direction. Because the first end 135A of lower conveyance member 130 may extend further than the second end 135AB of lower conveyance member 130 in the particular direction, the first end 135A of lower conveyance member 130 may be disposed closer to the image recording unit 4 in the conveyance direction than the second end 135B of lower conveyance member 130.

The second conveyance rollers 55B also may be positioned closer to the first end 135A of the lower conveyance member 130 than the second end 135B of the lower conveyance member 130. The second conveyance rollers 55B may convey the paper sheet S to first contact the downstream end portion 134 of the lower conveyance member 130 at a position closer to the second end 135B of the lower conveyance member 130 than the first end 135A of the lower conveyance member 130.

Figure 5:
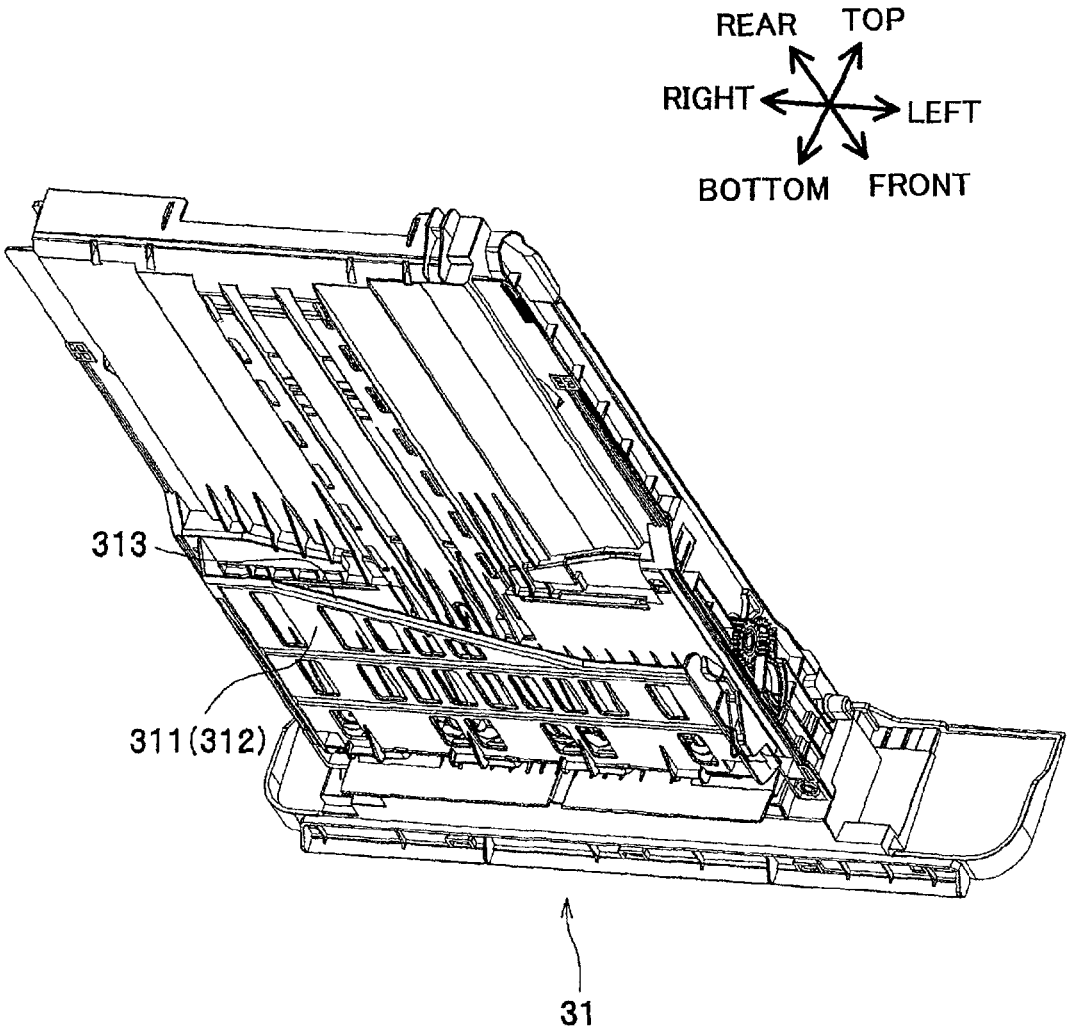
FIG. 5 is a bottom, perspective view of a paper feed tray, according to an embodiment of the invention.

As depicted in FIG. 5, a downstream path forming portion 311 may be disposed in the lower front portion of the paper feed tray 31. The downstream path forming portion 311 may comprise a path on which the paper sheet S fed from the guide member 110 of the re-conveying path 100 is conveyed. The downstream path forming portion 311 may be a portion of the conveying unit 5, e.g., which may form a front portion of the section of the re-conveying path 54 extending in the front-rear direction, as depicted in FIG. 1. The downstream end portion 134 of the re-conveying unit 100 may be connected to the downstream path forming portion 311.

Specifically, an upstream end portion 313 of a lower forming portion 312 that forms a lower portion of the downstream path forming portion 311 may have a shape that conforms to the downstream end portion 134 of the lower conveyance member 130. Because the paper feed tray 31 may be removably mounted to the apparatus main body 2, the downstream path forming portion 311 may be removably mounted to the re-conveying unit 100 of the apparatus main body 2.

Figure 6:
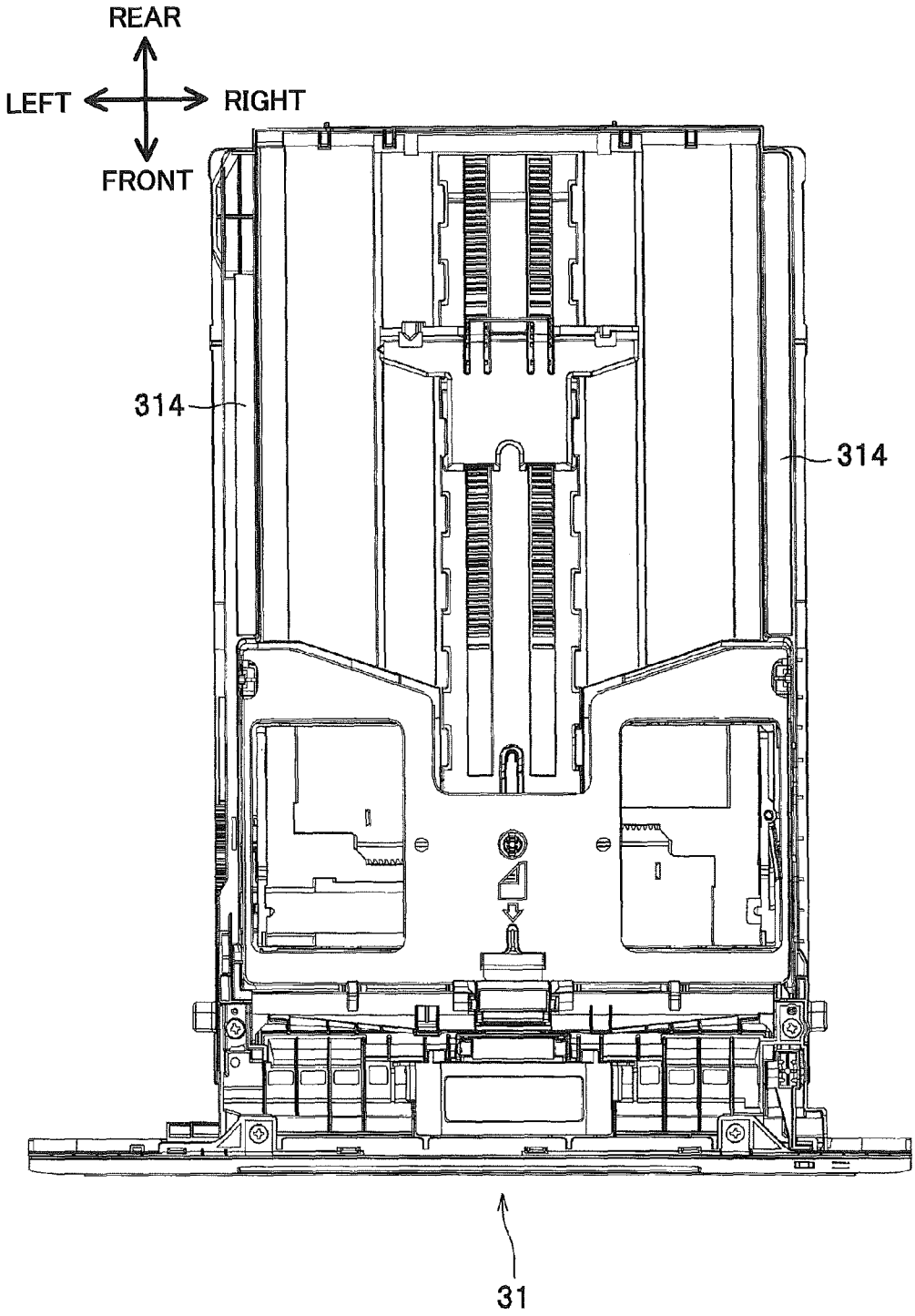
FIG. 6 is a top view of the paper feed tray, according to an embodiment of the invention.

As depicted in FIG. 6, a pair of both-side regulation members 314 may be disposed in the paper feed tray 31. Each of the pair of both-side regulation members 314 may contact with respective width direction ends of the paper sheet S, and may regulate the position of the paper sheet S in the width direction. With this configuration, for the printing on the first surface of the paper sheet S, both the right and left ends of the paper sheet S may contact with each both-side regulation members 314. Thus, the paper sheet S may be positioned in the width direction; and, for the printing on the second surface of the paper sheet S, the left end of the paper sheet S may contact with the single-side regulation member 120, which may position the paper sheet S in the width direction.

In the configuration described above, the following advantageous effects may be provided in the present embodiment. Because the coefficient of friction of the second pinch roller 162 is greater than that of the first pinch roller 152, frictional force with respect to the first surface of the paper sheet S may be provided by the second pinch roller 162 having high coefficient of friction even if the first pinch roller 152 slides on the first surface of the paper sheet S. As a result, oblique feeding capability of the conveyor rollers 55 may be improved.

In an embodiment of the invention, because the downstream end portion 134 of the lower conveyance member 130 is formed to incline toward the rear side from the left to the right side, the entire leading end of the paper sheet S may be prevented from being caught by the joint of the lower conveyance member 130 and the downstream path forming portion 311. Because the lower conveyance member 130 is formed to incline similarly to the upper conveyance member 140, the right corner of the paper sheet S may project from each of the downstream end portions 143 and 134 when the paper feed tray 31 is removed, thus providing a space for a user's fingers above and below the corner of the paper sheet S, thereby allowing a user to hold the corner of the paper sheet S from above and below with the fingers to thereby clear the jammed paper sheet S.

In another embodiment, the second end may be longer than the first end, and an angle formed by the first end and the downstream end may be greater than 90 degrees. In another embodiment, the downstream end may be curved. In another embodiment, the downstream end may have one or more straight portions and one or more angled portions.

In an embodiment of the invention, the upper conveyance member 140 may be formed from a metal. In addition, the upper conveyance member 140 may have a reduced thickness in the vertical direction and increased rigidity. Thus, the apparatus main body 2 may be compact in the vertical direction and, at the same time, deformation of the upper conveyance member 140 may be further reduced or prevented. In addition, in an embodiment of the invention, pinch rollers 152 and 162 and the torsion springs 154 and 164 are supported by the resin-made roller holders 153 and 163. In this embodiment, a holding configuration of the pinch rollers 152 and 162 may easily be formed.

In the above-described embodiments of the invention, the first pinch roller 152 may comprise a resin and the driving rollers 151 and 161 and the second pinch roller 162 may comprise a rubber. Nevertheless, the invention is not limited to this configuration. In other embodiments of the invention, the rollers may be made of any materials and configured in any manner such that the first driving roller 151 has a coefficient of friction which is greater than that of the first pinch roller 152 and the second pinch roller has a coefficient of friction which is greater than that of the first pinch roller is satisfied.

In the above-described embodiments of the invention, two pairs of the first conveyance rollers 55A may be provided in the above-described embodiment. Nevertheless, in other embodiments of the invention, the number of the pairs of the first conveyance rollers 55A may be one, or three or more.

In the above-described embodiments of the invention, the paper feed tray 31 may be removably mounted to the apparatus main body 2, and may be used as a recording sheet container unit. In other embodiments, however, the recording sheet container unit may be a paper feed tray which is merely movable with respect to the apparatus main body and thus is not removable from the apparatus main body. In still other embodiments, the recording sheet container unit may be removed from the apparatus main body 2 only by using a tool, e.g., a screwdriver. In yet other embodiments of the invention, the recording sheet container may be formed integrally with the apparatus main body at a lower portion of the apparatus main body. In further embodiments of the invention, the downstream path forming portion may be formed integrally with the apparatus main body, and the guide member may be removably mounted to the downstream path forming portion of the apparatus main body.

In the above-described embodiments, the image forming unit 4 may comprise the exposure unit 41. Nevertheless, in other embodiments, an LED head may be used instead of the exposure unit 41, a belt-like photoconductor may be used instead of the photosensitive drum 42A, and a cylindrical-shaped fixing film slidably supported by a guide may be used instead of the heat roller 44A. Other components, e.g., a conductive brush and a conductive plate spring, to which transfer bias is applied may be used instead of the transfer roller 43B.

Although the above-described embodiments refer to a color printer 1 for convenience, the invention is not limited to the same. For example, embodiments of the invention may be applied to a monochrome printer and any other image forming device, e.g., a copying machine and a multi-function device.

In the above-described embodiments of the invention, the re-conveyed paper sheet S is conveyed below the paper feed tray 31. Nevertheless, in other embodiments, for example, the re-conveyed paper sheet may be conveyed above the paper feed tray. In the above-described embodiments of the invention, the torsion springs 154 and 164 may be urging members. Nevertheless, in other embodiments of the invention, any other type of urging member may be used, e.g., a flat spring and wire spring.

In the above-described embodiments of the invention, the re-conveying unit 100 may be disposed below the paper feed tray 31, however, in other embodiments, the re-conveying unit 100 may be disposed above the paper feed tray 31. In addition, in the above-described embodiments, the upper conveyance member 140 may be formed from a metal sheet, however, in other embodiments, the upper conveyance member 140 may be formed of any other suitable material, e.g., a resin. In an embodiment of the invention, if the upper conveyance member 140 is formed of resin, the upper conveyance member 140 and the roller holder may be formed integrally with each other.

While the invention has been described in connection with the above embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. The specification and the described examples are considered as exemplary only, with the true scope and spirit of the invention indicated by the following claims.

What is claimed is:

1. An image forming device comprising:

a sheet conveying unit configured to convey a plurality of sheets;

an image forming unit configured to form an image on a first surface of a sheet that is conveyed from the plurality of sheets by the sheet conveying unit; and a re-conveying unit configured to re-convey the sheet along a re-conveying path to the image forming unit such that the image forming unit is configured to form another image on a second surface of the sheet opposite the first surface, wherein the re-conveying unit comprises:

a guide member comprising:

a lower conveyance member disposed below the re-conveying path; and an upper conveyance member secured to the lower conveyance member and disposed above the re-conveying path;

a single side regulation member extending in a particular direction and configured to contact a particular end of the sheet to regulate a position of the sheet;

a conveyor roller set configured to convey the sheet therebetween, wherein the conveyor roller set comprises:

a driving roller configured to receive a driving force; and a pinch roller disposed facing the driving roller;

an urging member configured to urge the pinch roller toward the driving roller; and a roller holder disposed above the upper conveyance member, wherein the upper conveyance member has a first end and a second end opposite to the first end in a direction perpendicular to the particular direction, wherein both the first end of the upper conveyance member and the second end of the upper conveyance member are secured to the lower conveyance member, wherein the roller holder is configured to secure the pinch roller to the upper conveyance member, wherein the roller holder is disposed to overlap the upper conveyance member in a vertical direction, wherein the roller holder is configured to secure the pinch roller such that the pinch roller is configured to contact the sheet through an opening formed in the upper conveyance member, and wherein the first end of the upper conveyance member extends further than the second end of the upper conveyance member in the particular direction.

2. The image forming apparatus of claim 1, wherein the upper conveyance member comprises a downstream end that extends from the first end of the upper conveyance member to the second end of the upper conveyance member at an angle relative to the direction perpendicular to the particular direction.

3. The image forming apparatus of claim 2, wherein the conveyor roller set is disposed closer to the first end than the second end of the upper conveyance member, and an angle formed by the first end and the downstream end is less than 90 degrees.

4. The image forming apparatus of claim 1, wherein the conveyor roller set is disposed closer to the first end than the second end of the upper conveyance member.

5. The image forming apparatus of claim 1, wherein the first end of the upper conveyance member extends closer to the image forming unit than the second end of the upper conveyance member along the conveyance path.

6. The image forming apparatus of claim 1, wherein the lower conveyance member comprises:

a first end of the lower conveyance member;

a second end of the lower conveyance member opposite to the first end of the lower conveyance member in the direction perpendicular to the particular direction; and a downstream end that extends from the first end of the lower conveyance member to the second end of the lower conveyance member at an angle relative to the particular direction.

7. The image forming apparatus of claim 6, wherein the conveyor roller set is disposed closer to the first end than the second end of the upper conveyance member, and an angle formed by the second end and the downstream end is less than 90 degrees.

8. The image forming apparatus of claim 7, wherein the conveyor roller set is disposed closer to the second end than the first end of the upper conveyance member.

9. The image forming apparatus of claim 1, wherein the lower conveyance member comprises:

a first end of the lower conveyance member;

a second end of the lower conveyance member opposite to the first end of the lower conveyance member in the particular direction; and a downstream end extending from the first end of the lower conveyance member to the second end of the lower conveyance member, such that the conveyance roller set is configured to convey the sheet to first contact the downstream end of the lower conveyance member at a position closer to the second end of the lower conveyance member then the first end of the lower conveyance member.

10. The image forming apparatus of claim 1, wherein the upper conveyance member comprises at least one rib extending from the first end of the upper conveyance member toward the second end of the upper conveyance member.

11. The image forming apparatus of claim 10, wherein each of the at least one ribs extends at an angle relative to the direction perpendicular to the particular direction.

12. The image forming apparatus of claim 1, wherein the upper conveyance member comprises a metal.

13. The image forming apparatus of claim 1, further comprising:

a sheet container unit configured to store the plurality of sheets therein and configured to slide in the particular direction.

14. An image forming device comprising:

a sheet conveying unit configured to convey a plurality of sheets;

an image forming unit configured to form an image on a first surface of a sheet that is conveyed from the plurality of sheets by the sheet conveying unit; and a re-conveying unit configured to re-convey the sheet along a re-conveying path to the image forming unit such that the image forming unit is configured to form another image on a second surface of the sheet opposite the first surface, wherein the re-conveying unit comprises:

a guide member comprising:

a lower conveyance member disposed below the re-conveying path; and an upper conveyance member secured to the lower conveyance member and disposed above the re-conveying path;

a single side regulation member extending in a particular direction and configured to contact a particular end of the sheet to regulate a position of the sheet;

a conveyor roller set configured to convey the sheet therebetween, wherein the conveyor roller set comprises:

a driving roller configured to receive a driving force; and a pinch roller disposed facing the driving roller;

an urging member configured to urge the pinch roller toward the driving roller; and a roller holder disposed above the upper conveyance member, wherein the upper conveyance member has a first end and a second end opposite to the first end in a direction perpendicular to the particular direction, wherein both the first end of the upper conveyance member and the second end of the upper conveyance member are secured to the lower conveyance member, wherein the roller holder is configured to secure the pinch roller to the upper conveyance member, wherein the roller holder is disposed to overlap the upper conveyance member in a vertical direction, wherein the roller holder is configured to secure the pinch roller such that the pinch roller is configured to contact the sheet through an opening formed in the upper conveyance member, a wherein the upper conveyance member comprises a downstream end that extends from the first end of the upper conveyance member to the second end of the upper conveyance member, and wherein an angle formed by the first end and the downstream end of the upper conveyance member is less than 90 degrees.

15. The image forming apparatus of claim 14, wherein the conveyor roller set is disposed closer to the first end than to the second end of the upper conveyance member.

16. An image forming device comprising:

a sheet conveying unit configured to convey a plurality of sheets;

an image forming unit configured to form an image on a first surface of a sheet that is conveyed from the plurality of sheets by the sheet conveying unit; and a re-conveying unit configured to re-convey the sheet along a re-conveying path to the image forming unit such that the image forming unit is configured to form another image on a second surface of the sheet opposite the first surface, wherein the re-conveying unit comprises:

a guide member comprising:

a lower conveyance member disposed below the re-conveying path; and an upper conveyance member secured to the lower conveyance member and disposed above the re-conveying path;

a single side regulation member extending in a particular direction and configured to contact a particular end of the sheet to regulate a position of the sheet;

a conveyor roller set configured to convey the sheet therebetween, wherein the conveyor roller set comprises:

a driving roller configured to receive a driving force; and a pinch roller disposed facing the driving roller;

an urging member configured to urge the pinch roller toward the driving roller; and a roller holder disposed above the upper conveyance member, wherein the upper conveyance member has a first end and a second end opposite to the first end in a direction perpendicular to the particular direction, wherein both the first end of the upper conveyance member and the second end of the upper conveyance member are secured to the lower conveyance member, wherein the roller holder is configured to secure the pinch roller to the upper conveyance member, wherein the roller holder is disposed to overlap the upper conveyance member in a vertical direction, wherein the roller holder is configured to secure the pinch roller such that the pinch roller is configured to contact the sheet through an opening formed in the upper conveyance member, wherein the lower conveyance member comprises a downstream end that extends from the first end of the lower conveyance member to the second end of the lower conveyance member, and wherein an angle formed by the first end and the downstream end of the lower conveyance member is less than 90 degrees.

17. An image forming device comprising:

a sheet conveying unit configured to convey a plurality of sheets;

an image forming unit configured to form an image on a first surface of a sheet that is conveyed from the plurality of sheets by the sheet conveying unit; and a re-conveying unit configured to re-convey the sheet along a re-conveying path to the image forming unit such that the image forming unit is configured to form another image on a second surface of the sheet opposite the first surface, wherein the re-conveying unit comprises:

a guide member comprising:

a lower conveyance member disposed below the re-conveying path; and an upper conveyance member secured to the lower conveyance member and disposed above the re-conveying path;

a single side regulation member extending in a particular direction and configured to contact a particular end of the sheet to regulate a position of the sheet;

a conveyor roller set configured to convey the sheet therebetween, wherein the conveyor roller set comprises:

a driving roller configured to receive a driving force; and a pinch roller disposed facing the driving roller;

wherein the upper conveyance member has a first end and a second end opposite to the first end in a direction perpendicular to the particular direction, wherein both the first end of the upper conveyance member and the second end of the upper conveyance member are secured to the lower conveyance member, and wherein the first end of the upper conveyance member extends closer to the image forming unit than to the second end of the upper conveyance member along the conveyance path.

* * * * *